US005197171A

United States Patent [19]

Hatfield

[11] Patent Number: 5,197,171

[45] Date of Patent: Mar. 30, 1993

[54] CABLE TERMINATING TOOL AND JIG

[75] Inventor: John G. Hatfield, Camp Hill, Pa.

[73] Assignee: AMP Incorporated, Harrisburg, Pa.

[21] Appl. No.: 496,745

[22] Filed: Mar. 21, 1990

[51] Int. Cl.[5] ..... H01R 43/04

[52] U.S. Cl. ..... 29/33 M; 29/753; 29/759

[58] Field of Search ..... 29/33 M, 749, 735, 753, 29/759, 566.1, 566.2, 566.3, 566.7, 566.4, 752, 750, 751

[56] References Cited

U.S. PATENT DOCUMENTS

| | | | |
|---|---|---|---|
| 3,742,571 | 7/1973 | Brehm | 29/751 X |
| 4,034,472 | 7/1977 | Cover et al. | 29/753 X |
| 4,210,997 | 7/1980 | Holt | 29/749 X |
| 4,238,874 | 12/1980 | Chandler et al. | 29/753 X |
| 4,389,769 | 6/1983 | Casey | 29/759 X |
| 4,453,307 | 6/1984 | Casey | 29/759 X |
| 4,517,718 | 5/1985 | Johnson, Jr. | 29/749 X |
| 4,642,874 | 2/1987 | Litehizer, Jr. | 29/753 X |
| 4,784,669 | 11/1988 | Maack | 29/759 X |
| 4,878,295 | 11/1989 | Muhlberger et al. | 29/749 X |
| 4,903,399 | 2/1990 | Billingham et al. | 29/735 |
| 4,926,538 | 5/1990 | Bond et al. | 29/749 |

*Primary Examiner*—William Briggs
*Attorney, Agent, or Firm*—James M. Trygg

[57] ABSTRACT

A tool (10) and a jig (70) include intermating surfaces to facilitate mounting of the jig in reverse relationship to facilitate wiring of different sizes of connectors (160) having top and bottom rows of terminals (176, 177) with the jig having projections (100–114) precisely positioning terminals and connectors relative to index projections (74) which engage index means (60) on the tool and clamp means to hold cable (140) and wire in appropriate positions for different connectors and a wedge shaped adjustment (42) affixed to the tool to vary inserter movement for different size wires.

17 Claims, 7 Drawing Sheets

140
142
125
123
144
120
129
116
118
114
122
127
126
129
70
130
72
128
112
50
12
14
24
40
64
66
68
61
62
60
19
42

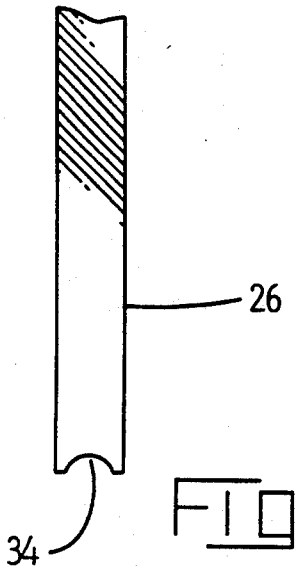
FIG. 5
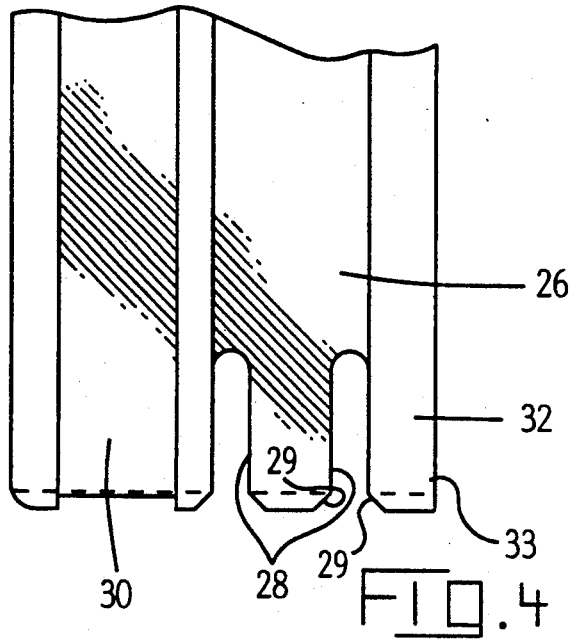
FIG. 4
FIG. 9
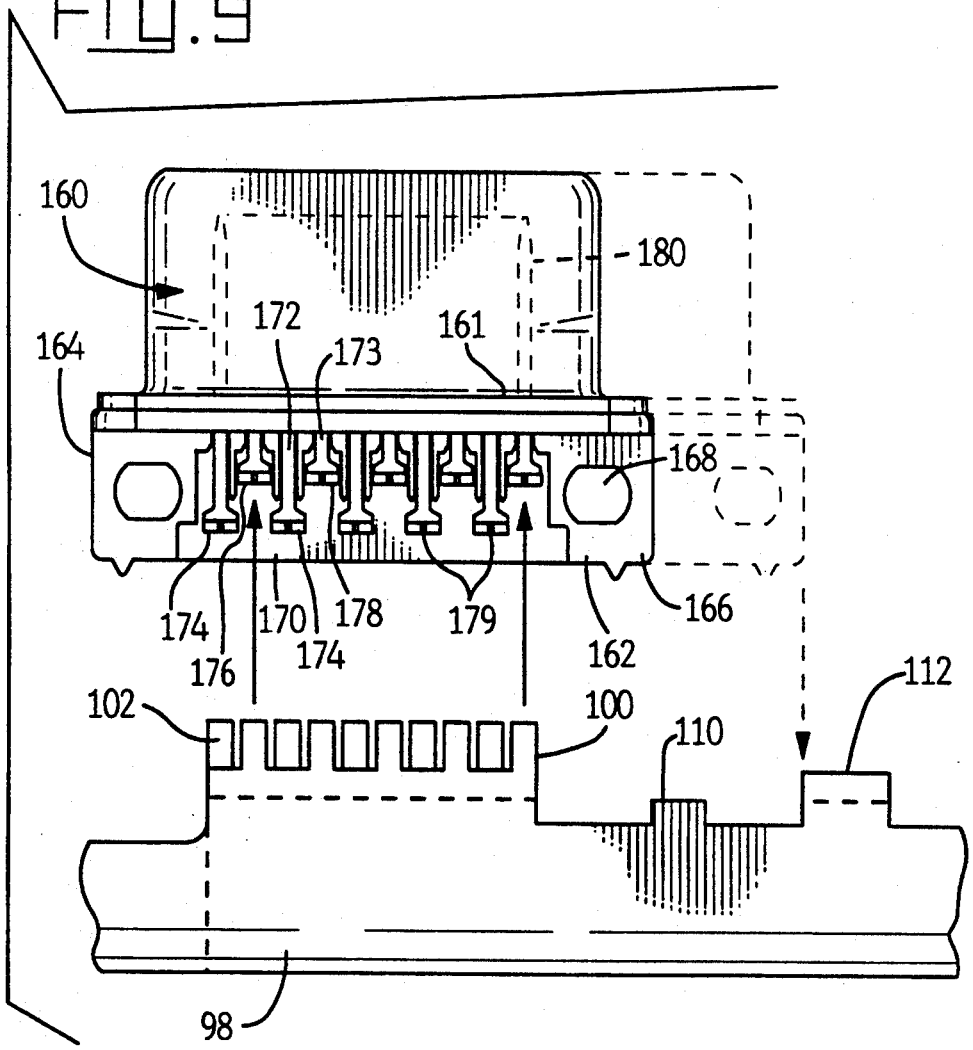

CABLE TERMINATING TOOL AND JIG

FIELD OF THE INVENTION

This invention relates to a tool and jig for terminating wires into electrical connectors wherein a variety of connector, cable and wire sizes can be readily accommodated.

BACKGROUND OF THE INVENTION

The practice of utilizing connectors of the type having many sizes within a family of connectors adapted to be used with many sizes of cables containing a variety of numbers and sizes of wires is wide spread. This fact, coupled with the extremely small dimensions of cable wires and connectors and terminals has presented a very complex problem for harness-making. One solution employs a wide variety of jigs, each configured to handle one or perhaps several of the variations and permutations possible with varying connector and wire sizes. This is expensive and troublesome in terms of parts which must be inventoried and caused to intermate for effective harness-making. Moreover, the very variety of connectors, cables, wires, and harness dimensions called for electrical and electronic equipment, including computers, business machines, telephone systems and the like, in essence renders the numbers of things that are identical relatively small. Relative to the tooling utilized for harness-making, the problem is complicated by the need for a large number of tools which are variable in nature, or alternately, very complex tools requiring significant set up time and expense to manufacture and maintain.

Accordingly, it is an object of the present invention to provide a tool and a jig in combination which is universal in the sense of accommodating families of connectors of different sizes as terminated to different cables having different wires therein in a simple, low cost, and easily used structure and mechanism. It is a further object to provide a tool which accommodates a wide variety of connector, cable, and wire parameters through a structure and mechanism facilitating a repetitive process of manufacture of cable assemblies with few adjustments required during use. It is still a further object of the invention to provide an improved tool for accommodating insulation displacement terminals and connectors of the type having multiple rows of terminals oppositely oriented on a given connector wherein there are connectors having sizes appropriate to different numbers of terminals over a relatively wide range of accommodated wires and sizes.

SUMMARY OF THE INVENTION

The present invention relates to the combination of a tool and jig for terminating wires in terminals of electrical connectors. The tool and jig are designed to accommodate a family of connectors wherein terminals are arranged in rows on the top and bottom of the connector and a jig is utilized for positioning the connector and terminals as well as the appropriate cable and wires for use in the tool. The tool includes wire guide means to receive and hold a wire for insertion into a given terminal as well as an inserter operable to insert wires into the terminal through a reciprocating movement relative to a tool base positioned between the wire guide means and the inserter. The base includes first surfaces adapted to receive the jig and connector in a sliding engagement with the jig having a frame including locator projections which engage and precisely position any one of a series of connectors of different sizes. The jig further includes an adjustable clamping and holding means to position a cable and the wires thereof on the jig. The jig is portable, or removable, relative to the tool and includes a series of second surfaces which engage the first surfaces of the tool to align the rows of terminals beneath the inserter of the tool for wire insertion. The tool and jig have index means which cooperatively engage to facilitate movement of the jig and the connector carried thereby incrementally relative to the terminals of the connector. The jig includes second surfaces on the top and bottom thereof to facilitate reversal of the jig relative to the base of the tool for wiring rows of terminals of a connector which are oppositely oriented and the jig further includes a cable clamping means which allows the cable to be positioned differently for different size connectors and to accommodate different sized cables. A wedge element is employed at right angles to the inserter displacement to adjust the displacement and accommodate differently sized wires in the terminal of a given connector.

The jig includes a frame having an array of projections which engage the terminals of a connector to precisely align the connector, the terminals on the jig and assure precise alignment relative to operation of the tool inserter. The invention jig features a novel arrangement of projections which in number equal the number of terminals in the smallest size of a connector family with an additional projection for each additional connector size.

DESCRIPTION OF THE DRAWINGS

FIG. 4 is a side elevational view of the end of the inserter of the tool.

FIG. 5 is a side view of the inserter end as shown in FIG. 4.

FIG. 9 is a plan view showing a connector having rows of terminals preparatory to being loaded onto the locator of the invention.

DETAILED DESCRIPTION OF THE INVENTION

Figure 1:
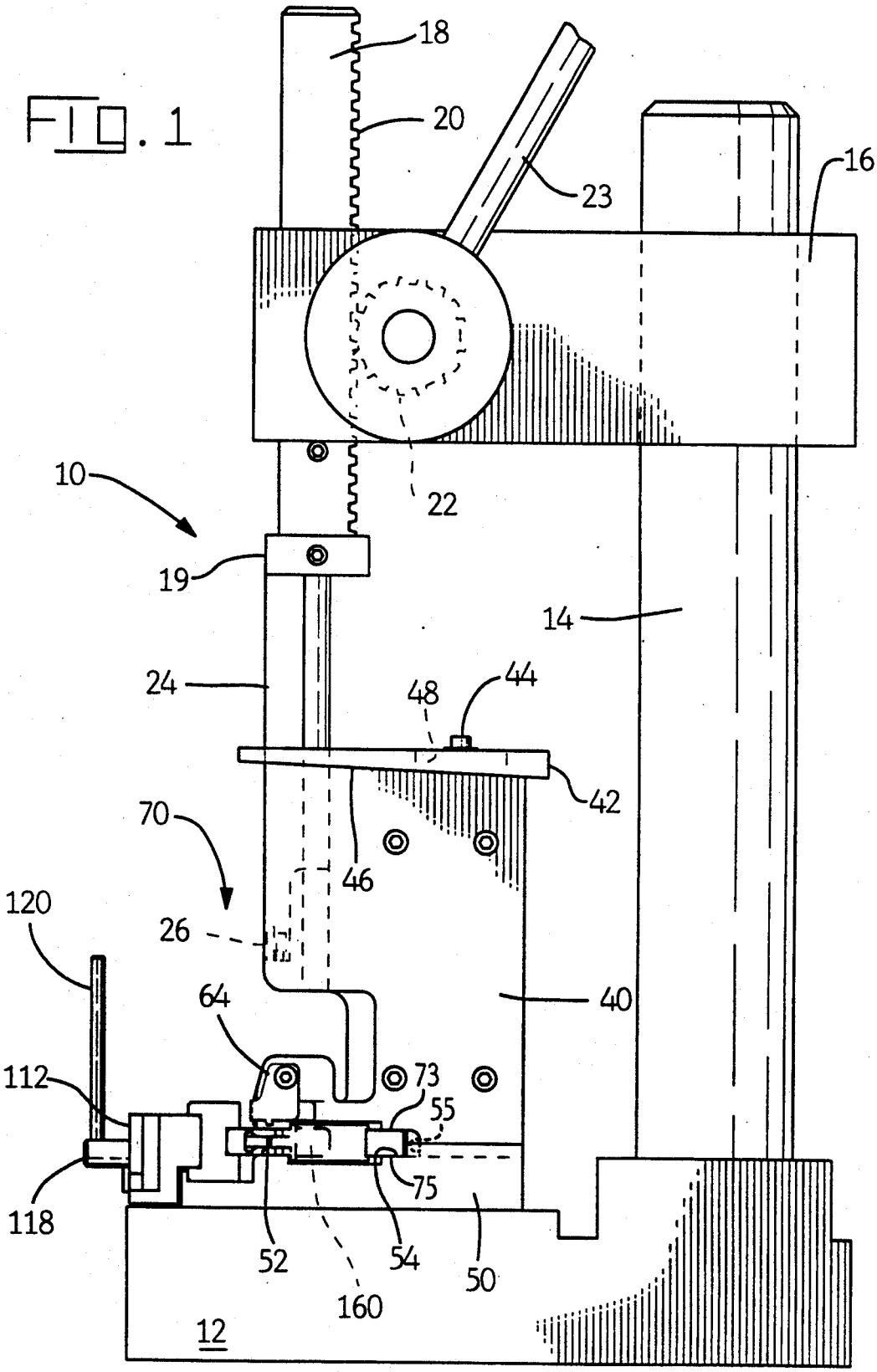
FIG. 1 is an elevational view including details in phantom to show the tool and the jig of the invention in operative relationship.
Figure 2:
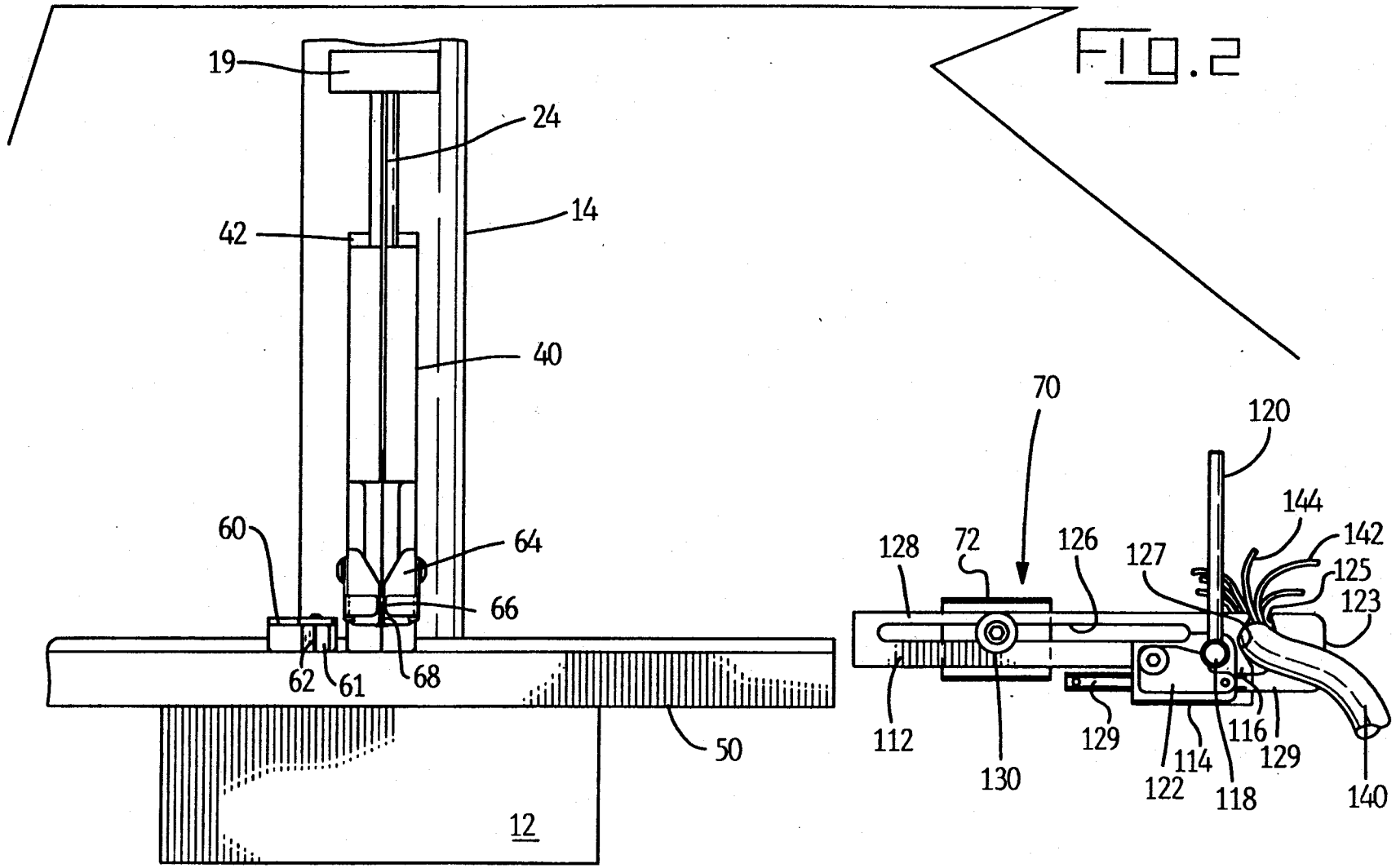
FIG. 2 is a front elevational view of the lower portion of the tool of FIG. 1 with the jig of FIG. 1 removed from the tool.
Figure 3:
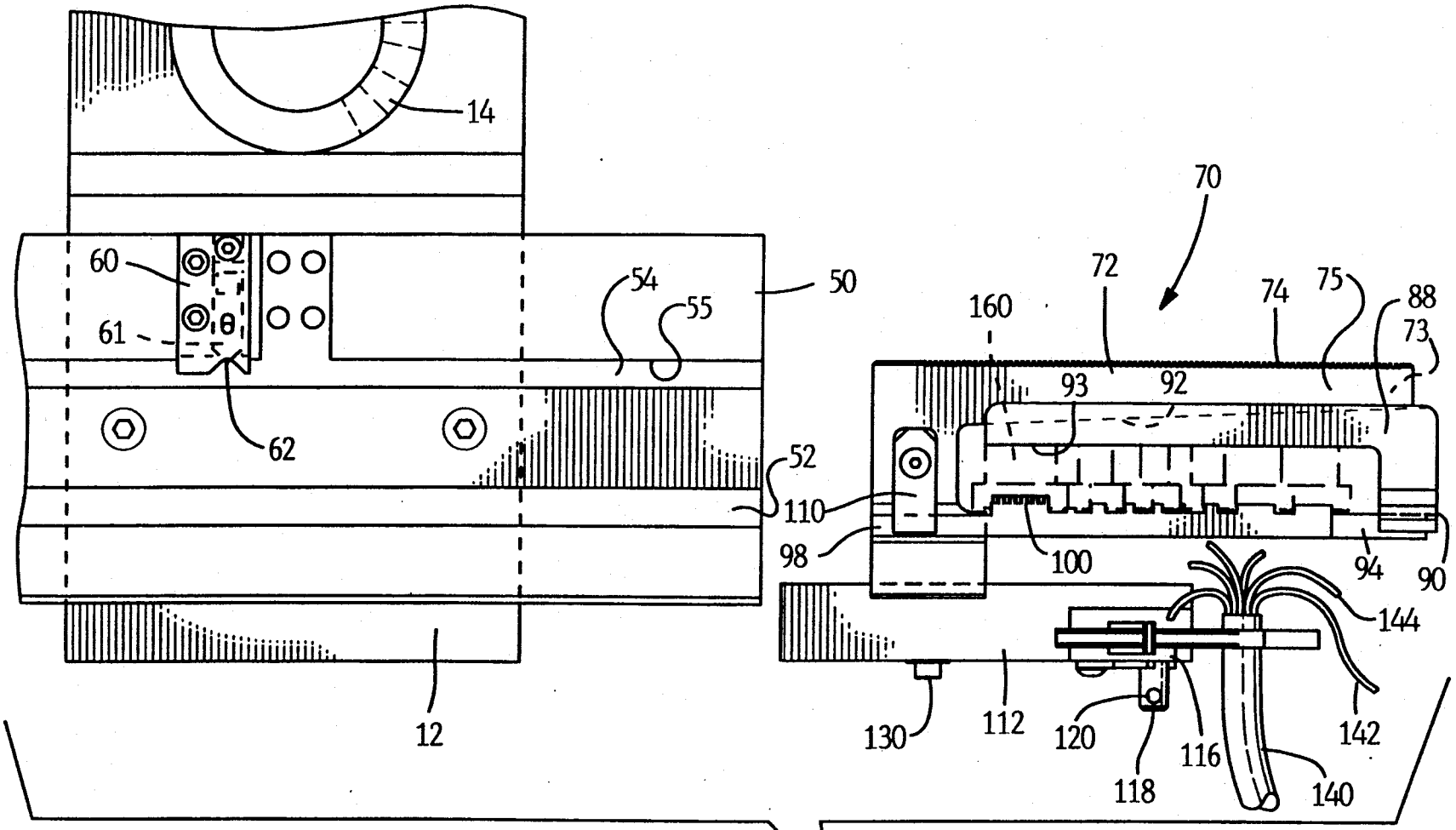
FIG. 3 is a plan view of the forward portions of the tool and jig of FIG. 2.
Figure 10:
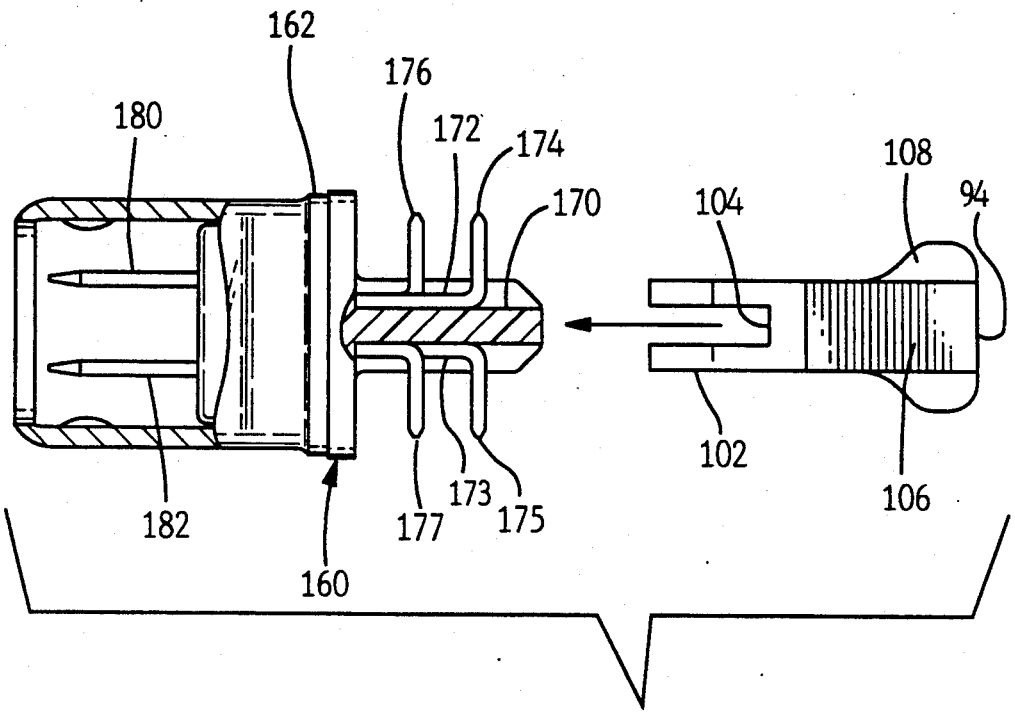
FIG. 10 is a side view of the connector and locator in partial section and phantom as shown in FIG. 9.
Figure 11:
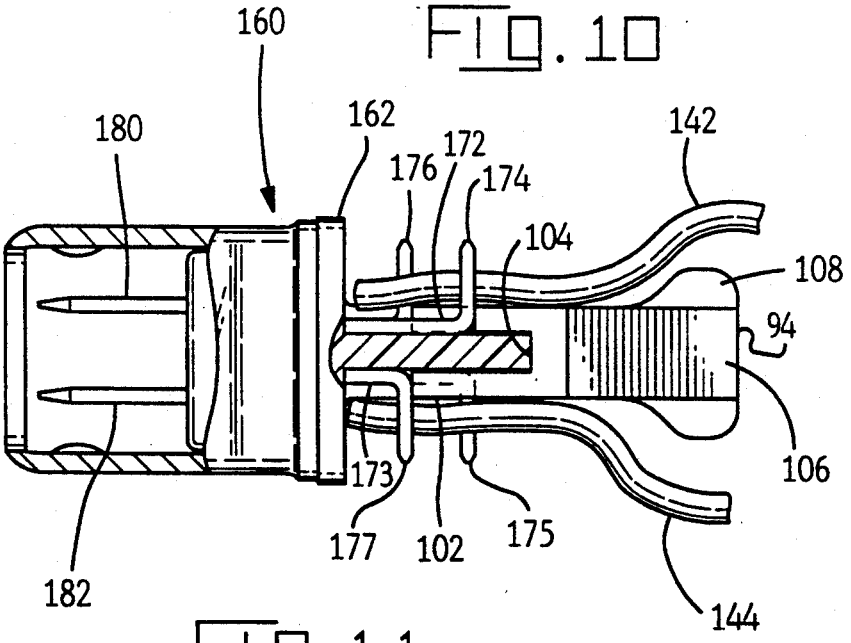
FIG. 11 is a view of the parts of FIG. 10 as assembled and having a pair of wires terminated into the terminals of the connector.

Referring first to FIGS. 1–3, a tool 10 will be seen in relationship to a fixture or jig 70, an electric cable 140 and wires 142 shown in FIG. 3. The tool and jig are utilized to terminate the cable and wires to a connector shown in FIG. 1 as 160 and shown in more detail in FIGS. 9–11. The connector 160 is of a type widely utilized for interconnecting multi-wire circuits such as are used in computers, business machines, and telephone systems and the like. Referring briefly to FIGS. 9-11, the connector 160 includes a plastic housing 162 which contains a series of terminals 180, 182 arranged in top and bottom rows and each including terminal ends of the insulation displacement type in this particularly illustrative embodiment which are terminated as shown in FIG. 11 to wires 142 and 144. The terminals 180, 182 project via portions 172, 173 rearwardly to join the terminal ends 174, 175.

Connectors such as 160 frequently come in multiple sizes, the term size being used to mean that different connectors in a series or family of connectors have different numbers of terminals. For example, it is common to have a connector family having 10, 20, 30, 40, 50, and 60 or more terminals forming multiple sizes. The connectors may have two or more rows, two rows being shown relative to connector 160 positioned as shown in FIG. 10 relative to terminal ends 174, 176 oriented upwardly or toward the top of the connector and alternatively, a lower row having ends oriented downwardly toward the bottom of the connector as indicated by terminal ends 175, 177. The various terminals are made to extend on centers which are common to the connectors of a given family; such centers varying with different connector designs but for example, having a spacing of 0.100 inches between adjacent terminals of a given row or 0.050 inches between adjacent terminals on a given side, top or bottom of the connector.

The terminals shown in connector 160 are of a type called generally I.D.C.; standing for Insulation Displacement Connector and U.S. Pat. No. 3,820,055 granted Jun. 25, 1972 to C. Hufnagle details the I.D.C. concept. The terminals at the ends thereof have slots 179 spaced apart to strip the insulation from a wire and bite into and deform the center conductor of wires; either a single solid strand or multiple strands are being widely used. The terminals frequently have a funnel-shaped entry to center the wire during installation. Most I.D.C. designs will accommodate a range of wire sizes, including wires which have different outer diameters due to a different thickness of insulation or, in a limited way, different wire core diameters for a range of gauges such as for example, two A.W.G. gauges for a given I.D.C. slot dimension.

Wires are provided through the use of a cable such as 140 as shown in FIG. 3 which may be frequently shielded as by a wire mesh extended around the wires beneath an outer insulation sheath. In practice, a cable such as 140 is terminated at one or both ends by a connector like 160; or, alternatively, terminated at one end by a similar connector and terminated in some other fashion at the other end. Such cables as terminated become harness units.

In accordance with the invention as indicated in FIGS. 1-3, the invention embraces the tool and a fixture adapted to accommodate a wide range of cable wire and connector products. Referring again to FIGS. 1-3, the tool 10 may be seen to have ram upstanding post 14 rigidly affixed to a base 12 and carrying an arm 16 which projects out over the base 12 and is spaced therefrom The arm 16 carries at its end, in an aperture not detailed, a ram 18 which is made to include teeth 20 shown in phantom in FIG. 1 engaged by the teeth of a gear 22 mounted for rotation within arm 16 as manipulated via a handle or arm 23 in a clockwise or counter-clockwise sense to drive ram 18 upwardly or downwardly relative to base 12. The ram 18 terminates in a chuck 19 made to carry an inserter 24 which ends in wire stuffing and cut-off surfaces. In FIG. 4, the grooves shown as 28 of inserter 24 are positioned to engage the upstanding portions of the terminals such as portions 174 and 176 of the terminals as shown in FIGS. 9-11. The slots 28 are beveled at their end as at 29 to tend to funnel the body of the terminals into the slots and adjacent the slots 28 is a portion shown as 30 which may be utilized to press the wire downwardly during the insertion stroke of the inserter. The end projection shown as 32 in FIG. 4 is given a cutting edge 33 which severs the end of the wire overlaid the connector, which end is then removed and discarded. Viewing FIG. 5, the end of inserter 26 is seen to be rounded as at 34 which tends to gather or center a given wire for insertion during displacement of the inserter. The inserter operates to terminate one wire at a time as the connector is indexed transversely across the base through use of the jig in a manner to be described. As this occurs, the left-handed slot, as shown in FIG. 4, engages the rearward row of terminals, one at a time, such as terminal end 174 and then upon indexing the right-handed slot of the slots 28 engages the terminal end of the adjacent terminal such as end 176.

Referring now to FIG. 1, the base 12 may be seen to contain an upstanding and vertical inserter guide 40 which includes mounted on the top thereof a wedge shaped element 42 bolted to 40 as at 44 and having a surface tapered as at 46 with an internal slot 48 shown to allow the wedge element to be moved horizontally on the top of 40. The wedge element is made to have a taper on the order of 2½ degrees relative to horizontal so that horizontal movement of the wedge element lifts the upper surface thereof incrementally to vary the stroke of ram 18 by engaging the undersurface of chuck 19 upon its displacement. The 2½ degree taper of wedge 42 achieves a one to twenty-five ratio in terms of change in vertical displacement of the ram versus changes in horizontal displacement of the wedge. This allows a manual positioning of the wedge which can alter the ram displacement up or down a few thousandths of an inch which in turn alters the displacement of the inserter surfaces and the positioning of a wire in the slot of a terminal end in a vertical sense. This feature is important in accommodating wires of different diameters and different sizes relative to the I.D.C. concept.

Mounted on the top of base 12 and forming a part thereof is a horizontal guide element 50 which is made to contain a series of surfaces 52 and 54 which operate to guide a jig slidingly along the upper surface of 50 in a precise manner. As can be seen in FIG. 3, the surfaces 52-54 traverse the upper surface of 50 and lead to an indexing mechanism shown as 60 in FIGS. 2 and 3. The indexing mechanism includes a detent 61 which is spring loaded outwardly into the path of the jig 70 as it moves along the surface of 50. The mechanism includes a projecting end 62 which is tightly radiused to fit within a series of projections 74 on an edge surface of the jig in a manner to be described.

As shown in FIG. 2, there is additionally included as a part of guide 40 a V-shaped wire guide shown as 64 made of opposing parts containing wire gripping elements 66 and 68 which are spring driven inwardly to receive and hold a wire for termination in a connector upon cycling of the tool and driving the inserter downwardly. The guide 64 may be viewed in relationship to a connector 160 and the terminal ends in FIG. 1.

Figure 6:
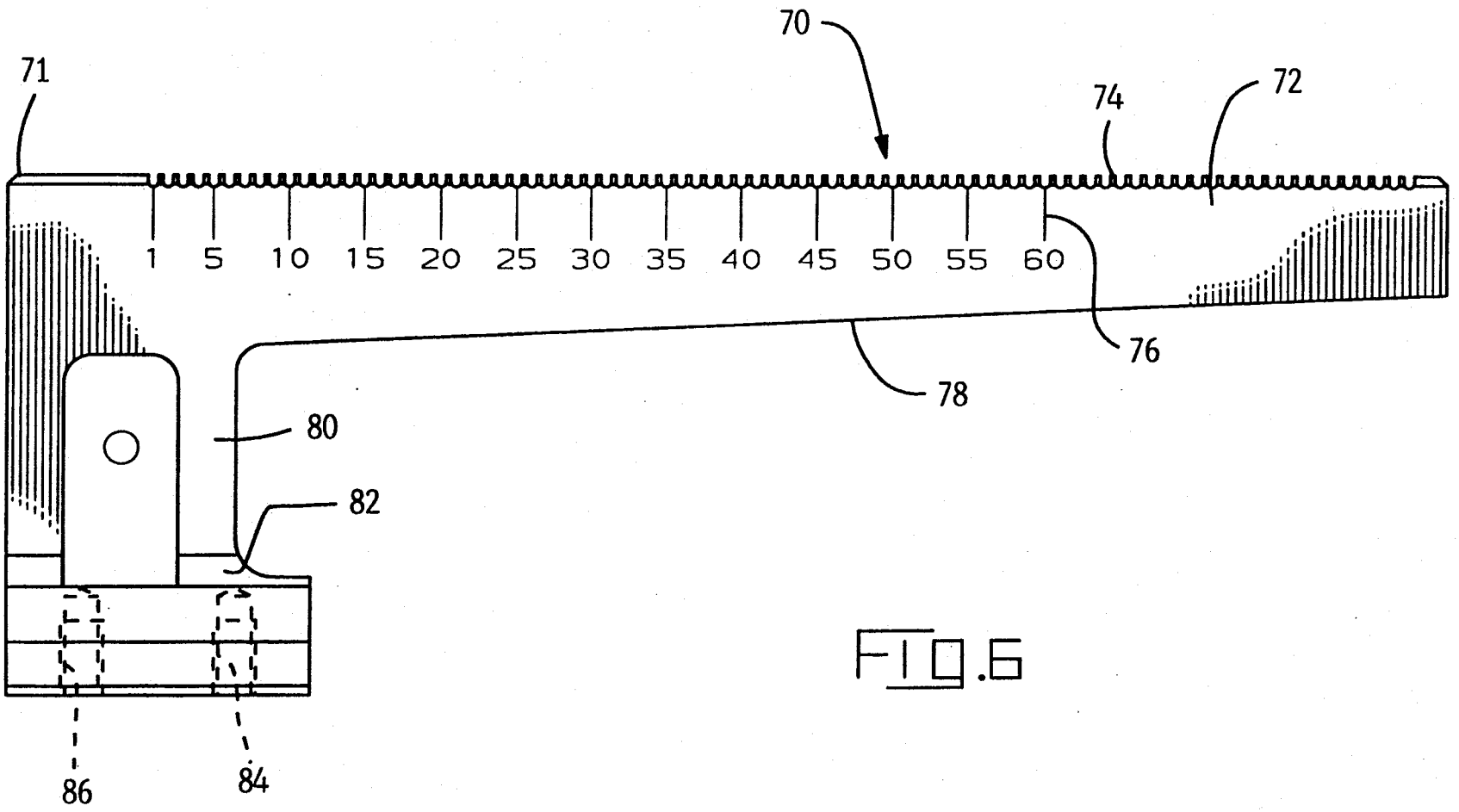
FIG. 6 is a plan view of a portion of the jig and the frame thereof.

Referring now to FIG. 3, a jig 70 is shown to include a frame 72 containing on the upper edge surface the projections 74 heretofore mentioned. The projections 74 can be better seen in FIG. 6 to extend substantially across the upper edge of frame 72 and as shown by the numeral 76 are preferably marked for every five projections relative to the slots defined between projections. In use, the slots between projections are engaged by the radius surface of 62 to control the displacement of the frame 72 incrementally along the surface of 50. In accordance with the invention concept, the engagement and cooperative action of the slots defined by projection 74 and the indexing mechanism serve to align a connector precisely relative to the terminal portions thereof and relative to the end of inserter 26 which defines wire stuffing and cut-off surfaces In accordance with the invention, the projections are made in number to at least equal the number of contacts on one side of a connector of a given connector family. Thus, with respect to the frame shown in FIG. 6, some sixty projections and indentations are marked out to function with connectors having as few as several terminals on a given side defined in the present example as shown in FIG. 9 in two rows on each side of a connector. The frame 72 could be used quite readily with connectors having as many as sixty terminals on a given side and in fact, additional projections 74 are included for connector sizes larger than those having sixty terminals per side. FIG. 6 also reveals that the frame 72 includes a lower edge surface 78 opposite the projection 74 which is tapered vary slightly, a 2½ degree taper being employed in an actual unit, and made to cooperate with a clamp 88 as shown in FIG. 3 which holds a connector in place in the jig.

Frame 72 further includes a projecting bridge portion 80 which contains a slot 82 and fastening means 84 and 86 adapted to receive and contain a cable clamp 112 as shown in FIG. 3. The connector clamp 88 includes a projection 90 which engages the end surface of a connector mounting rack 94 as shown in FIG. 3 and opposite to 90 and extending along the length thereof, a tapered surface 92 made to slidingly engage the tapered surface 78, of frame 70.

Figure 8:
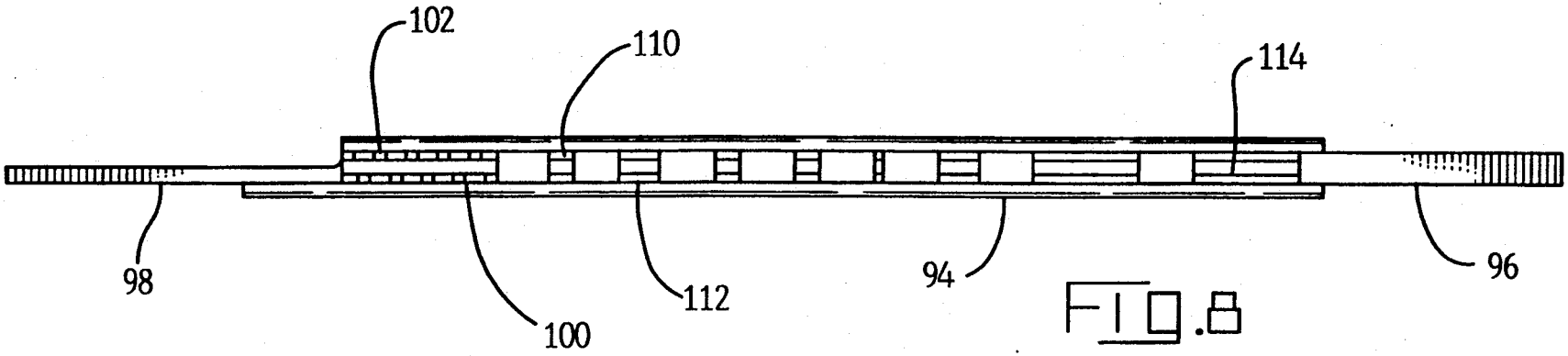
FIG. 8 is an elevational view of the locator of FIG. 7.
Figure 7:
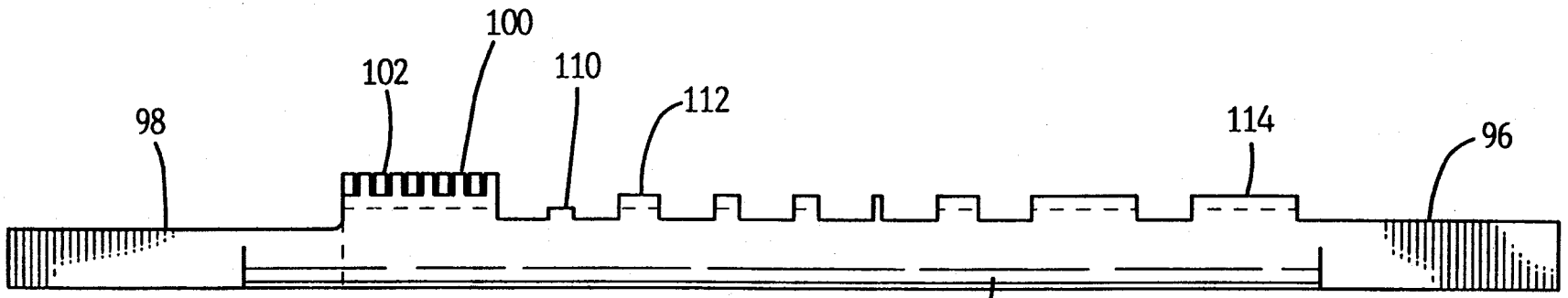
FIG. 7 is a plan view of the locator of the jig of the invention.

FIGS. 7 and 8 show rack 94 which forms part of the frame of the invention and which serves to precisely position a connector relative to the frame and jig and relative to the inserter and its operation to stuff and cut wire. The rack 94 includes an end 96 which is generally rectangular in cross-section and which receives in bearing engagement the end portion 90 of the clamp 88; and opposite thereto, an end 98 which fits within the slot 82 in the frame 70 and is locked thereto by a clamp shown as 110 in FIG. 3. Rack 94 may be seen to have a series of projections 100 which define spaces or slots in an upper row of projections and similar projections 102 defining a lower or bottom row of projections. The cross-sectional configuration of rack 94 can be seen in FIGS. 10 and 11 to be generally U-shaped, the projections defining a bite shown as 104 which fits over a projecting plastic portion 170 of connector 160. The several projections 100 and 102 extend to engage the inner row of the top and bottom rows of terminals with the width of the projections 100 and 102 controlled to fit between adjacent terminal ends of the outboard row of terminals. In FIG. 9, the projections 100 and 102 are shown aligned relative to a connector 160 spaced from the projections but preparatory to being inserted thereon. FIG. 11 shows the connector so inserted.

As depicted in FIGS. 10 and 11, the rack in the region containing projections 100, 102 includes a body 106 having at the outside edges rounded surfaces 108 which hold the wires outwardly following termination to allow the connector to be readily removed from the rack following termination. Returning to FIGS. 7 and 8, a series of further projections shown as 110, 112–114 are made to extend from the rack to define slots therebetween. The purpose of these further projections and the slots theredefined is to accommodate connectors of larger sizes than that shown in FIG. 9. The connector 160 is made to include a plastic housing 162 which has at each end a projecting portion 164 and 166-apertured as at 168 to facilitate the addition of parts, not shown, of the connector which cover over the terminal ends and serve to shield and interconnect the grounding and shielding of cables. As indicated in FIG. 9 the end element 166 is made to be of a precise width so as to fit within the slots defined by the several projections 110–114 to hold a given connector positioned precisely in the rack. The first ten projections, projections 100 and 102 thus provide a precise alignment of a connector relative to the first ten terminals thereof and the projections 110–114 through the slots therebetween engage the end such as the end 166 and hold the connector in rack 94. This facilitates the precise mounting of even very large connectors which might otherwise generate a frictional loading problem were the projections 100, 102 extended fully along a rack 94.

Returning now to FIGS. 1–3, the jig 70 may be seen to further include a cable clamp 112 which is fitted to the lower portion 80 of the frame 72. As can be seen in FIGS. 2 and 3, the clamp 112 includes a locking element 114 which operates by frictionally engaging a plate 116 as driven by a shaft 118 rotated through a handle shown as 120 in FIGS. 1–3. The clamp 112 further includes a sliding element 123 having an inner surface rounded as at 125 to engage the outside edge of the cable 140 in the manner shown in FIGS. 2 and 3 and draw such cable in against a surface shown as 127, also rounded and clamp such cable against relative movement. The clamp may be seen in FIG. 2 to include a slot 126 extending in a projecting portion 128 and through which a bolt 130 is employed to lock the clamp to the frame 72. In practice, with the sliding element 123 in an open position, a cable may be laid in the clamp with 123 being pushed inwardly to clamp the cable, its lower projecting portion shown as 129 being then locked inwardly by rotation of handle 120. Next, the entire clamp may be moved along relative to the frame so that the cable is centered relative to the particular connector being terminated. Thus, with respect to FIG. 3, a large connector extending over the length of rack 94 would find the clamp positioned to more or less center the cable relative to the rack and for smaller connectors, the clamp would be displaced to the left from that shown in FIG. 3 to center the cable toward the left end of the rack. The invention also fully contemplates an application and dressing of cable from one end of a connector or the other depending on applications and packaging requirements.

In practice, a cable 140 will first be clamped by the clamp 112 with the wires 142 destined to be terminated to the top portion of a connector separated into one group and folded back and over the top of the jig and the wires 144 destined to be terminated in the bottom of a connector folded back oppositely. Next, the clamp 112 will be centered appropriately for the connector to be terminated and the connector 160 mounted on the rack 94 and shoved inwardly so that the several projections nest appropriately in engagement with the terminals of the connector and therebetween so that an end portion 166 rests within an appropriate slot defined by the projections 110–114 as shown in FIG. 11. Next, the clamp 88 is positioned in place and hand-forced to drive and hold the connector in place within the rack. Thereafter, the jig 70 containing the connector, cable and wires may be placed upon guide element 50 with the surfaces 52 and 54 engaging the jig. This will cause surfaces 73 or 75 on the upper and lower surfaces of the jig, depending upon the orientation of the jig, to engage the surfaces 52 and 54 extending in the upper surface of 50, part of the base to guide and align the jig vertically in sliding movement along the surface 50. Projection 34 will align surface 55 to position the jig horizontally As this occurs, the end corner shown as 71 of jig 70 in FIG. 6 will strike the edge projection 62 of the indexing mechanism 60 so that the indexing mechanism will ride along the upper surface of the frame 72. The space between the first projection 74 will receive the projecting surface 62 and provide a readily discernible detent to stop the jig in the proper position for termination of the first wire in the upper or top portion of a connector. That wire is then laced into the wire guide 64 as shown in FIG. 2 with the wire being clamped and held by elements 66 and 68. Thereafter, the tool may be cycled with the ram driven downwardly to cause the inserter to insert a wire 142 within the slot of the first terminal; terminal 174 of the connector 160 shown in FIG. 9 and in the manner shown in FIG. 11. At that time edge 33 of the inserter cuts the free end of the wire. The jig will then be displaced to the left with the index mechanism, end surface 62 providing a tangible feel to position the jig along the next center line of the connector with a further wire being laced into the wire guide 64 and the tool cycled to terminate the wire in the next terminal which, in the case of the connector 160 shown in FIG. 9, would be terminal end 176. With each termination, the wire end cut off by the inserter tool would be removed and discarded. The jig is manipulated until all wires are terminated in the top of the connector and then the jig is removed, reversed, and reinstalled with the edge surface 74 of the jig made to engage the surface 55 and surface 73 engaging surface 54 for alignment. The jig is then displaced along the surface 50 of the tool base with the lower, or bottom, terminals now oriented upwardly, terminated by wires in the manner heretofore described. Following this operation, the connector is removed from the jig, first removing the clamp 88 and then loosening the cable clamp 112 and moving the connector and cable forwardly within the frame 72 and sliding it to the right relative to the frame shown in FIG. 3 over the various projections 100, 102, and 110–114. Thereafter, the connector would have the remaining shielding and clamping elements attached.

In the event that cable characteristics change, such as change in wire diameter, the tool 10 would be adjusted by manipulation of the wedge element 42 to alter the inserter stroke and alter the positioning of the wire within the terminal end appropriately. As mentioned, manipulation of the clamp allows changes in cable diameter and cable positioning in accordance with connector sizes.

It is to be noted that the foregoing operation as described requires very few steps and no particular fine adjustments relative to the mounting of cable, connector, termination thereof, and removal from the tool of a completed assembly.

While the tool has been illustrated in a manual form, it is fully contemplated that inserter operation may be modified to be driven by electric, hydraulic, or pneumatic mechanisms.

Having now defined the invention in terms intended to enable a preferred practice thereof, I set forth what is believed to be invented in the attached claims:

I claim:

1. In combination, a tool and jig for terminating wires in terminals of a series of electrical connectors of different sizes defined by numbers of terminals and connector length, the tool including wire guide means to receive and hold a wire for insertion into a given terminal, an inserter operable to insert a wire into a give terminal, and a base positioned beneath said wire guide means and said inserter, said base of jig including guide surfaces adapted to support and position said jig in sliding engagement in top or bottom oriented positions and align said jig relative to said inserter, the tool including indexing means having a detent operable to index said jig in said sliding engagement on said base when said jig is in top or bottom positions, said jig including a frame having a connector locator including a series of projections adapted to engage and precisely position any one of the series of connectors of different lengths within said jig and further an adjustable clamping and holding means to position a cable and the wires thereof on said jig, the said jig further including projecting along one edge engaging the index means of said tool to align a given terminal in a connector in either the top or bottom positions of said jig relative to the said inserter and tool for wire termination.

2. The combination of claim 1 wherein the said clamping and holding means includes an adjustment means to hold cable and wires in different positions for different lengths of connectors of the said series of connectors.

3. The combination of claim 1 including a means to adjust the vertical displacement of the said inserter relative to the said base and jig to accommodate wires of different diameters as terminated in said terminals.

4. The combination of claim 3 wherein the said means to adjust displacement is comprised of a wedge element slidingly mounted at right angles to the movement of said inserter with the said wedge element providing a vertical adjustment on the order of one unit to fifteen to thirty units of displacement at right angles to inserter movement.

5. The combination of claim 1 wherein the said projections of the said frame includes an array of one projection for each terminal of a connector having the fewest number of terminals of the series of connectors and in addition one further projection for each additional size connector of said series of connectors having a greater number of terminals than the connector having the fewest number of terminals.

6. The combination of claim 1 wherein the said projections have a width and are spaced apart to engage the terminals of a connector and extend therebetween to align the said terminals relative to said frame and jig.

7. The combination of claim 1 wherein the said projections are defined by a U-shaped element dimensioned to receive plastic portions of the connector inserted therein to align the said connector in a vertical sense relative to said jig.

8. In a tool and jig for terminating connectors to wires of an electrical cable of a type having a plurality of rows of terminals oppositely oriented in the top and bottom of a connector, a tool base having a horizontal surface grooved to define surfaces to receive matching surfaces on said jig extending from the top and bottom of said jig to allow placement of said jig in top or bottom orientation upon said tool, a ram carrying a wire inserter for reciprocal movement perpendicular to said base, index means including a series of projecting surfaces and a spring loaded index pin engaging said surface to index a connector one increment for each terminal of the connector, the said index means being carried by said too and jig for cooperative operation, the said jig including means to mount and hold the connector, cable and wires affixed to said jig with said indexing means operable in either of said jig top or bottom positions whereby to facilitate wiring of a connector having top and bottom rows of terminals extending oppositely from the said connector.

9. The tool and jig of claim 8 wherein the said jig includes a frame having a clamp operable to clamp cable to said frame and adjustable means to move said cable relative to said frame to accommodate different sizes of connectors.

10. The tool and jig of claim 8 wherein the said jig includes a frame having a series of projections which engage terminals of connectors to precisely position a connector on said frame.

11. In a tool and jig for terminating connectors to an electrical cable wherein the connector includes a series of sizes having different numbers of terminals and geometries relative to each size, the improvement comprising a frame having a first series of projections, one each for each terminal of the largest size connector of the series to index the frame relative to the tool, a second series of projections positioned to engage a plurality of terminals of a connector to precisely position said connector upon said frame and locking means to lock said connector to said second series projections.

12. The tool and jig of claim 11 wherein there is included projections on the top and bottom surfaces of said frame to engage rows of terminals on the top and bottom of a given connector.

13. The tool and jig of claim 11 wherein the said locking means includes wedge surfaces providing sliding movement relative to the frame to provide locking action of a given connector.

14. The tool and jig of claim 11 wherein the said second projections include one each for each terminal of the smallest size connector and at least one further projection for each additional connector of the series of connectors.

15. The tool and jig of claim 11 wherein the said second series of projections include widths and spacing to fit between the terminals and rows of terminals of said connector to provide precise placement of a connector relative to said frame, tool, and jig.

16. The tool and jig of claim 11 wherein the said jig and tool include matching surfaces for sliding movement of said jig in said tool in two orientations of said jig said tool.

17. The tool and jig of claim 11 wherein the said tool has guide surfaces to receive said jig and said jig has top and bottom surfaces matched to guide surfaces to facilitate the wiring of the top and bottom projecting terminals of a connector.

* * * * *

UNITED STATES PATENT AND TRADEMARK OFFICE

CERTIFICATE OF CORRECTION

PATENT NO. : 5,197,171

DATED : March 30, 1993

INVENTOR(S) : John G. Hatfield

It is certified that error appears in the above-identified patent and that said Letters Patent is hereby corrected as shown below:

Claim 1, line 19, column 8, "give" should be --given--.

Claim 8, line 14, column 9, "face" should be --faces--.

Claim 8, line 16, column 9, "too" should be --tool--.

Claim 16, line 28, column10, --in-- should be inserted after the word "jig".

Signed and Sealed this

Third Day of January, 1995

Bruce Lehman

*Attest:*

BRUCE LEHMAN

*Attesting Officer*

*Commissioner of Patents and Trademarks*